US009294842B2

(12) United States Patent
Qiu

(10) Patent No.: US 9,294,842 B2
(45) Date of Patent: Mar. 22, 2016

(54) HEAT DISSIPATION DEVICE FOR MOVING-COIL LOUDSPEAKER

(71) Applicant: Xiangkang Qiu, Shanghai (CN)

(72) Inventor: Xiangkang Qiu, Shanghai (CN)

( * ) Notice: Subject to any disclaimer, the term of this patent is extended or adjusted under 35 U.S.C. 154(b) by 0 days.

(21) Appl. No.: 14/445,796

(22) Filed: Jul. 29, 2014

(65) Prior Publication Data

US 2014/0348373 A1 Nov. 27, 2014

Related U.S. Application Data

(63) Continuation of application No. PCT/CN2013/000046, filed on Jan. 17, 2013.

(30) Foreign Application Priority Data

Jan. 29, 2012 (CN) ..... 2012 1 0026897

(51) Int. Cl.
*H04R 9/02* (2006.01)
*H04R 31/00* (2006.01)

(52) U.S. Cl.
CPC ..... *H04R 9/022* (2013.01); *H04R 31/006* (2013.01); *H04R 9/025* (2013.01); *H04R 2209/00* (2013.01)

(58) Field of Classification Search
CPC ..... H04R 9/02; H04R 9/022; H04R 9/025; H04R 9/027; H04R 9/045; H04R 31/006; H04R 2209/00; H04R 2209/024; H04R 2400/07; H04R 2400/11
USPC ..... 381/386, 393–433, 189, 164, 166
See application file for complete search history.

(56) References Cited

U.S. PATENT DOCUMENTS 3,991,286 A * 11/1976 Henricksen ..... 381/189
4,210,778 A * 7/1980 Sakurai et al. ..... 381/349
5,426,707 A * 6/1995 Wijnker ..... 381/397
5,430,804 A * 7/1995 Wijnker ..... 381/410

(Continued)

FOREIGN PATENT DOCUMENTS

CN 102547537 A 7/2012
CN 202679597 U 1/2013

OTHER PUBLICATIONS

State Intellectual Property Office of the People's Republic of China (ISR/CN), International Search Report for PCT/CN2013/000046, Apr. 18, 2013.

(Continued)

*Primary Examiner* — Curtis Kuntz
*Assistant Examiner* — Joshua Kaufman
(74) *Attorney, Agent, or Firm* — Tim Tingkang Xia; Locke Lord LLP

(57) ABSTRACT

A heat dissipation device for a moving-coil loudspeaker, including a thermally conductive pad, a thermally conductive bar, and a heat sink that are integrally mounted at an axially central portion of the loudspeaker. The thermally conductive bar is axially connected to the thermally conductive pad and the heat sink at top and bottom thereof respectively, the thermally conductive bar is axially provided with a through hole or a groove at a circle center thereof, the heat sink is axially provided with a through hole in which a screw is tapped, a central groove at a top end of the thermally conductive bar is aligned with a groove on the thermally conductive pad to form a straight line groove such that a communication passage leading to an exterior of the loudspeaker is for the electronic components on a circuit board.

17 Claims, 4 Drawing Sheets

(56) References Cited

U.S. PATENT DOCUMENTS

| | | | | |
|---|---|---|---|---|
| 5,497,428 | A * | 3/1996 | Rojas | 381/414 |
| 6,243,472 | B1 * | 6/2001 | Bilan et al. | 381/117 |
| 6,243,479 | B1 * | 6/2001 | Proni | 381/420 |
| 6,327,371 | B1 * | 12/2001 | Proni | 381/397 |
| 6,373,957 | B1 * | 4/2002 | Stewart | 381/397 |
| 6,390,231 | B1 * | 5/2002 | Howze | 181/148 |
| 6,535,613 | B1 * | 3/2003 | Ssutu | 381/397 |
| 6,711,269 | B2 * | 3/2004 | Kobayashi et al. | 381/117 |
| 7,272,238 | B2 * | 9/2007 | Kemmerer et al. | 381/414 |
| 7,804,976 | B1 * | 9/2010 | Parham | 381/397 |
| 8,588,449 | B2 * | 11/2013 | Ouweltjes et al. | 381/338 |
| 2001/0031063 | A1 * | 10/2001 | Langford et al. | 381/397 |
| 2006/0078151 | A1 * | 4/2006 | Kemmerer et al. | 381/397 |
| 2007/0177756 | A1 * | 8/2007 | Kemmerer | 381/397 |
| 2009/0046887 | A1 * | 2/2009 | Lin | 381/397 |
| 2011/0116662 | A1 * | 5/2011 | Yuze et al. | 381/184 |
| 2014/0348373 | A1 * | 11/2014 | Qiu | 381/397 |
| 2015/0003663 | A1 * | 1/2015 | Biessy et al. | 381/400 |

OTHER PUBLICATIONS

Vance Dickason, The Loudspeaker Design Cookbook, 2006, 7th Edition, Audio Amateur Press, Peterborough, New Hampshire.

* cited by examiner

HEAT DISSIPATION DEVICE FOR MOVING-COIL LOUDSPEAKER

CROSS-REFERENCE TO RELATED APPLICATIONS

This application is a continuation of International Patent Application No. PCT/CN2013/000046, with an international filing date of Jan. 17, 2013, designating the United States, now pending, which is based on Chinese Patent Application No. 201210026897.6, filed Jan. 29, 2012. The contents of these specifications are incorporated herein by reference.

TECHNICAL FIELD

The present invention relates to the field of loudspeaker technologies, and in particular, relates to a heat dissipation device for a moving-coil loudspeaker.

BACKGROUND

As electronic products develop towards compactness, high power, and multimedia functionality, loudspeakers mating the electronic devices also need to adapt to greater power-volume ratio (a ratio of power to volume) and other electrical functions integrated therein (for example, sensors and emitters). Therefore, the heat generated by the voice coil of the loudspeaker and the electronic components in the speaker cannot be effectively dissipated under traditional heat dissipation conditions, which hinders development of high power-volume ratio and multimedia functionality of the loudspeaker.

SUMMARY

An objective of the present invention is to design a heat dissipation device for a moving-coil loudspeaker, to transfer heat generated by a voice coil and electronic components of the voice coil to the outside of the loudspeaker, and meanwhile providing a communication passage for the electronic components and the exterior of the loudspeaker.

A technical solution according to the present invention is mounting a three-in-one suite formed of a thermally conductive pad, a thermally conductive bar, and a heat sink at an axial central portion of the loudspeaker, and transferring the heat collected by the thermally conductive pad from the voice coil and the electronic components, through the loudspeaker via the thermally conductive bar, to the heat sink. The thermally conductive pad is positioned on one end of the voice coil of the loudspeaker, and near by an upper magnetically conductive plate or a surface of magnetic column. The thermally conductive pad is axially provided with an opening at a center thereof and radially provided with a groove crossing a circle center thereof. The thermally conductive and the thermally conductive bar are combined into an integral heat conduction bar which is axially provided with grooves on lateral sides. The thermally conductive bar is axially provided with an opening at a center thereof, and passes through an axial central structure portion of the loudspeaker, wherein one end is connected to the thermally conductive pad, and the other end is connected to the heat sink. The heat sink is positioned at an exterior of a lower magnetically conductive plate of an out-magnet loudspeaker or an exterior of a magnetically conductive bowl of an inner-magnet loudspeaker. The heat sink of the outer-magnet loudspeaker is of a sheet shape, and the heat sink of the inner-magnet loudspeaker is of a bowl shape. The thermally conductive pad, the thermally conductive bar, and the heat sink are made of a thermally conductive metal.

In the application of the heat dissipation device in an inner-magnet loudspeaker, a magnetic column, a permanent magnet, and a magnetically conductive bowl of the inner-magnet loudspeaker are each axially provided with a through hole at a center thereof. The circular sheet-shaped thermally conductive pad is axially provided with a through hole at a circle center thereof, and is radially provided with a groove crossing the circle center on a plane. The bolt-shaped thermally conductive bar is axially provided with a through hole at a circle center thereof, and one end of the thermally conductive bar is radially provided with a groove crossing the circle center and the other end is twisted with threads. The bowl-shaped heat sink is provided with a through hole in which a screw is tapped. The thermally conductive bar hole-to-hole and groove-to-groove sequentially passes through the thermally conductive pad, the magnetic column, the permanent magnet, the magnetically conductive bowl, and the bowl-shaped heat sink, and fastens the bowl-shaped heat sink via the threads of the thermally conductive bar, and fixes the heat dissipation device on a basin frame of the loudspeaker.

In the application of the heat dissipation device in an outer-magnet loudspeaker, a magnetic column and a lower magnetically conductive plate of the outer-magnet loudspeaker are each axially provided with a through hole at a circle center thereof. The circular sheet-shaped thermally conductive pad and the thermally conductive bar are integrally combined into a bolt-shaped thermally conductive bar, where the thermally conductive bar is axially provided with grooves at two sides thereof, and one end of the thermally conductive bar is twisted with threads. The circular sheet-shaped heat sink is provided with a through hole in which a screw is tapped. The thermally conductive bar hole-to-hole and thread-to-thread sequentially passes through the magnetic column, the lower magnetically conductive plate, and the sheet-shaped heat sink, fastens the circular sheet-shaped heat sink via the threads of the thermally conductive bar, and fixes the heat dissipation device on the lower magnetically conductive plate of the loudspeaker.

The heat dissipation device designed for a moving-coil loudspeaker according to the present invention has the following advantages:

1. The heat generated by the voice coil may be transferred through the thermally conductive pad, the thermally conductive bar, and the heat sink via a magnetic fluid to the exterior of the loudspeaker, and the bowl-shaped heat sink may transfer the heat generated by the voice coil to the basin frame of the loudspeaker. In this way, the heat generated by the voice coil may be transferred outside the loudspeaker.

2. The heat generated by the electronic components on the circuit board mounted on the thermally conductive pad may be transferred through the thermally conductive pad, the thermally conductive bar, and the heat sink, to the exterior of the loudspeaker.

3. The metal thermally conductive pad is positioned inside the voice coil, and abuts against the windings of the voice coil, which achieves the function of a short circuit loop, reduces the inductance of the voice coil, and is favorable to reduction of harmonic distortion of the loudspeaker.

DETAILED DESCRIPTION

Embodiment 1

Figure 1:
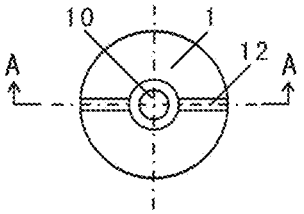
FIG. 1 is a front view of a thermally conductive pad according to Embodiment 1 of the present invention.
Figure 2:
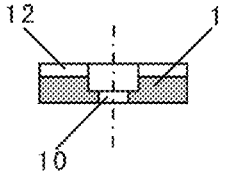
FIG. 2 is an A-A sectional view of the thermally conductive pad in FIG. 1.
Figure 3:
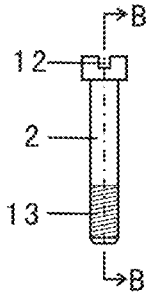
FIG. 3 is a front view of a thermally conductive bar according to Embodiment 1 of the present invention.
Figure 4:
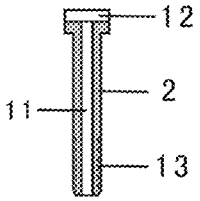
FIG. 4 is a B-B sectional view of the thermally conductive bar in FIG. 3.
Figure 5:
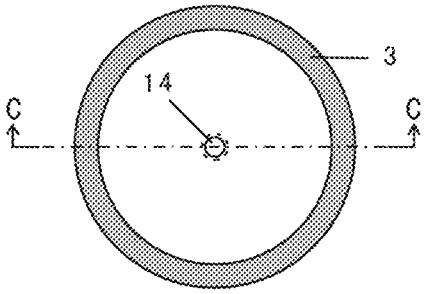
FIG. 5 is a front view of a heat sink according to Embodiment 1 of the present invention.
Figure 6:
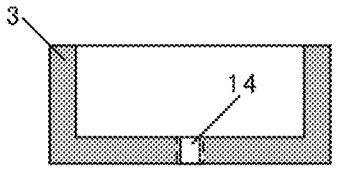
FIG. 6 is a C-C sectional view of the heat sink in FIG. 5.
Figure 7:
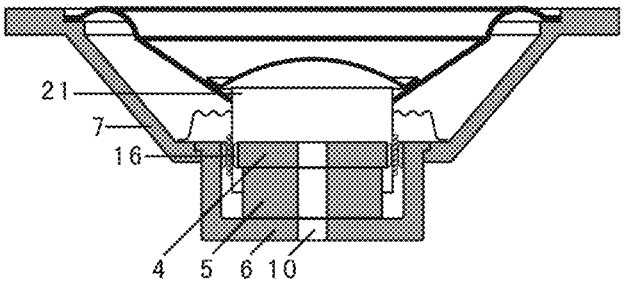
FIG. 7 is a sectional view of an opening axially provided on an inner-magnet loudspeaker according to Embodiment 1 of the present invention.
Figure 8:
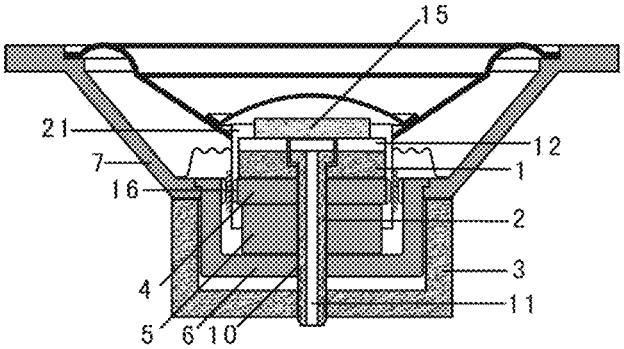
FIG. 8 is schematic view of assembly of the heat dissipation device according to Embodiment 1 of the present invention.

FIG. 1 to FIG. 8 are schematic structural views of a heat dissipation device for an inner-magnet loudspeaker according to this embodiment.

The heat dissipation device for the inner-magnet loudspeaker according to this embodiment comprises a circular sheet-shaped thermally conductive pad 1, a bolt-shaped thermally conductive bar 2, and a bowl-shaped heat sink 3. The inner-magnet loudspeaker comprises a magnetic column 4, a permanent magnet 5, and a magnetically conductive bowl 6 that are each axially provided with a through hole 10 at a circle center thereof.

The circular sheet-shaped thermally conductive pad 1 is axially provided with a through hole 10 at a circle center thereof, and is radially provided with a groove 12 crossing the circle center on a plane.

The bolt-shaped thermally conductive bar 2 is axially provided with a through hole 11 at a circle center thereof, is radially provided with a groove 12 crossing the circle center on a top plane thereof, and is twisted with threads 13 at a tail end thereof.

The bowl-shaped heat sink 3 is provided with a through hole in which a screw 14 is tapped.

The assembly according to this embodiment is as follows:

A plane with no grooves provided thereon of the thermally conductive pad 1 is mounted as abutting against the magnetic column 4. Then, the thermally conductive bar 3 hole-to-hole sequentially passes through the thermally conductive pad 1, the magnetic column 4, and the permanent magnet 5, and fastens and locks the bowl-shaped heat sink 3 via the threads 13 and the screws 14, such that the bowl-shaped heat sink is tightly clasped on a basin frame 7 of the inner-magnet loudspeaker. In addition, the center of the top end of the thermally conductive bar is aligned with the groove 12 on the thermally conductive pad to form a straight line groove.

A grooved plane of the thermally conductive bar 1 may be mounted as abutting against a circuit board 15 having electronic components.

Heat generated by a voice coil 21 is transferred through the circular sheet-shaped thermally conductive pad 1, the bolt-shaped thermally conductive bar 2, and the bowl-shaped heat sink 3 via a magnetic fluid 16, to the basin frame 7 of the loudspeaker.

Heat generated by the electronic components is transferred through the circular sheet-shaped thermally conductive pad 1, the bolt-shaped thermally conductive bar 2, and the bowl-shaped heat sink 3 via the circuit board 15, to the basin frame 7 of the loudspeaker.

The grooves 12 on the thermally conductive pad 1 and the thermally conductive bar 2 and the through hole 11 inside the thermally conductive bar 2 provide a communication passage leading to the exterior of the loudspeaker for the electronic components on the circuit board.

Generally, the loudspeakers are used for cooperation with the speaker, and the basin frame of the loudspeaker is positioned outside the speaker. In this embodiment, the heat generated by the voice coil and electronic components is transferred to the basin frame 7 of the loudspeaker. If a cast aluminum basin frame, the heat dissipation effect is improved.

In the heat dissipation device for the inner-magnet loudspeaker according to this embodiment, the inductance of the voice coil is less than that before the heat dissipation device is installed; and in addition, the heat dissipation device further achieves a function of a short circuit loop.

Embodiment 2

Figure 9:
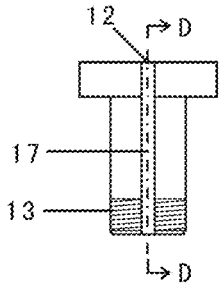
FIG. 9 is a front view of a thermally conductive bar integrally formed by a thermally conductive pad and a thermally conductive bar according to Embodiment 2 of the present invention.
Figure 10:
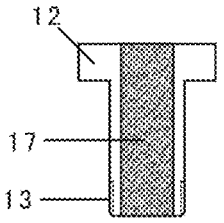
FIG. 10 is a D-D sectional view of the thermally conductive bar in FIG. 9.
Figure 11:
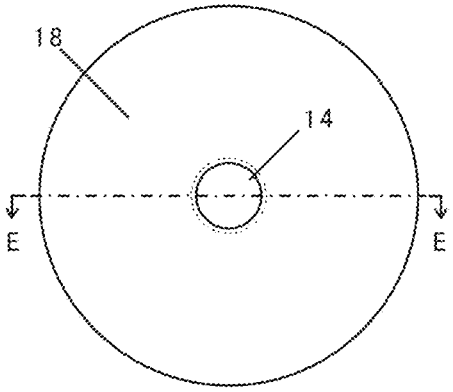
FIG. 11 is a front view of a heat sink according to Embodiment 2 of the present invention.
Figure 12:
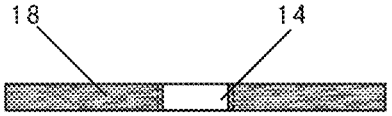
FIG. 12 is an E-E sectional view of the heat sink in FIG. 11.
Figure 13:
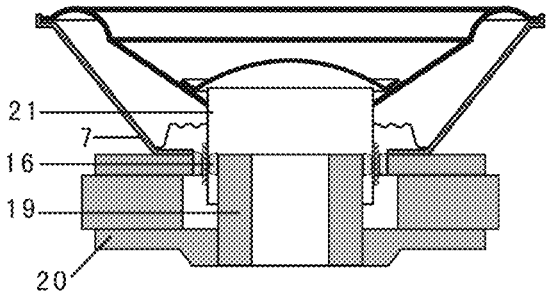
FIG. 13 is a sectional view of an opening axially provided on an outer-magnet loudspeaker according to Embodiment 2 of the present invention.
Figure 14:
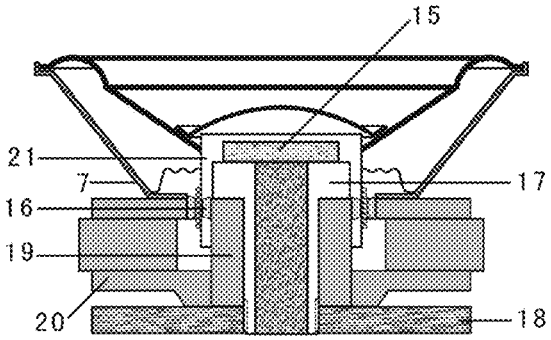
FIG. 14 is schematic view of assembly of the heat dissipation device according to Embodiment 2 of the present invention.

FIG. 9 to FIG. 14 are schematic structural views of a heat dissipation device for an outer-magnet loudspeaker according to this embodiment.

The heat dissipation device for the out-magnet loudspeaker according to this embodiment comprises a bolt-shaped thermally conductive bar 17 integrally formed by a thermally conductive pad and a thermally conductive bar, and a sheet-shaped heat sink 18.

A magnetic pole 19 of the out-magnet loudspeaker and a lower magnetically conductive plate 20 are each axially provided with a through hole 10 at a circle center thereof.

The thermally conductive bar 17 is axially provided with grooves 12 at two lateral sides thereof, and a tail end thereof is twisted with threads 13.

The sheet-shaped heat sink 18 is provided with a through hole in which a screw 14 is tapped.

The assembly according to this embodiment is as follows:

The thermally conductive bar 17 hole-to-hole passes through the magnetic pole 19 and the lower magnetically conductive plate 20, and fastens and locks the sheet-shaped heat sink outside the lower magnetically conductive plate of the sheet-shaped heat sink 18 via the threads 13 and screws 14.

An upper-end plane of the thermally conductive bar 17 may be mounted as abutting against a circuit board 15 having electronic components.

Heat generated by the voice coil is transferred through the bolt-shaped thermally conductive bear 17 via a magnetic fluid 16, to the sheet-shaped heat sink 18.

Heat generated by the electronic components is transferred through the bolt-shaped thermally conductive bear 17 via the circuit board 15, to the sheet-shaped heat sink 18.

The thermally conductive bar 17 is axially provided with grooves 12 at two sides thereof, such that a communication passage leading to an exterior of the loudspeaker is provided for the electronic components on the circuit board.

The lower magnetically conductive plate of the out-magnet loudspeaker has a greater diameter, and the sheet-shaped heat sink 18 has sufficiently great area. Therefore, better heat dissipation effect can be achieved.

In the heat dissipation device for the out-magnet loudspeaker according to this embodiment, the inductance of the voice coil is less than that before the heat dissipation device is installed; and in addition, the heat dissipation device further achieves the function of a short circuit loop.

What is claimed is:

1. A heat dissipation device for a moving-coil loudspeaker, comprising: a thermally conductive pad, a thermally conductive bar, and a heat sink, wherein the thermally conductive pad, the thermally conductive bar and the heat sink are mounted at an axially central portion of the moving-coil loudspeaker; wherein: the thermally conductive bar is axially connected to the thermally conductive pad and the heat sink at top and bottom thereof respectively, the thermally conductive bar is axially provided with a through hole or a groove at a circle center thereof, the heat sink is axially provided with a through hole, an upper-end plane of the thermally conductive pad is mounted as abutting against a circuit board formed of electronic components, a central groove at a top end of the thermally conductive bar is aligned with a groove on the thermally conductive pad to form a straight line groove such that a communication passage leading to an exterior of the moving-coil loudspeaker is provided for the electronic components on the circuit board.

2. The heat dissipation device for a moving-coil loudspeaker according to claim 1, wherein the thermally conductive pad is positioned at one end of a voice coil of the moving-coil loudspeaker, and is mounted as abutting against a surface of an upper magnetically conductive plate of the moving-coil loudspeaker or a magnetic column of the moving-coil loudspeaker.

3. The heat dissipation device for a moving-coil loudspeaker according to claim 1, wherein the thermally conductive pad is axially provided with an opening at a center thereof and radially provided with a groove crossing a circle center thereof.

4. The heat dissipation device for a moving-coil loudspeaker according to claim 1, wherein the thermally conductive pad and the thermally conductive bar are combined into an integral heat conduction bar which is axially provided with grooves on lateral sides.

5. The heat dissipation device for a moving-coil loudspeaker according to claim 4, wherein the there are two lateral sides.

6. The heat dissipation device for a moving-coil loudspeaker according to claim 1, wherein the moving-coil loudspeaker is an outer-magnet loudspeaker or an inner-magnet loudspeaker, the heat sink is positioned at an exterior of a lower magnetically conductive plate of the outer-magnet loudspeaker or an exterior of a magnetically conductive bowl of the inner-magnet loudspeaker, and the lower magnetically conductive plate of the outer-magnet loudspeaker or the magnetically conductive bowl of the inner-magnet loudspeaker is axially provided with a through hole at a circle center thereof.

7. The heat dissipation device for a moving-coil loudspeaker according to claim 6, wherein a heat sink of the outer-magnet loudspeaker is of a sheet shape, or a heat sink of the inner-magnet loudspeaker is of a bowl shape.

8. The heat dissipation device for a moving-coil loudspeaker according to claim 6, wherein a magnetic column and a permanent magnet of the inner-magnet loudspeaker are both axially provided with a through hole at circle centers thereof, a non-grooved plane of the thermally conductive pad abuts against a magnetic column of the inner-magnet loudspeaker, the thermally conductive bar hole-to-hole passes through the thermally conductive pad, the magnetic column, and the permanent magnet sequentially, and fastens and locks the heat sink via threads and screws, such that the heat sink is tightly clasped on a basin frame of the inner magnet loudspeaker.

9. The heat dissipation device for a moving-coil loudspeaker according to claim 6, wherein a magnetic pole of the outer-magnet loudspeaker is axially provided with a through hole at a circle center thereof, the thermally conductive bar hole-to-hole passes through the magnetic pole and the lower magnetically conductive plate sequentially, and fastens and locks the heat sink outside the lower magnetically conductive plate via threads and screws.

10. The heat dissipation device for a moving-coil loudspeaker according to claim 1, wherein the thermally conductive pad, the thermally conductive bar, and the heat sink are made of a thermally conductive metal.

11. The heat dissipation device for a moving-coil loudspeaker according to claim 1, wherein the thermally conductive bar is a bolt-shaped thermally conductive bar and is twisted with threads at a tail end thereof.

12. The heat dissipation device for a moving-coil loudspeaker according to claim 1, wherein a basin frame of the moving-coil loudspeaker is positioned outside a speaker, heat generated by a voice coil and the electronic components of the moving-coil loudspeaker is transferred to the basin frame of the moving-coil loudspeaker, and is dissipated outside the speaker.

13. The heat dissipation device for a moving-coil loudspeaker according to claim 12, wherein the basin frame of the moving-coil loudspeaker is a cast aluminum basin frame.

14. The heat dissipation device for a moving-coil loudspeaker according to claim 1, wherein heat generated by a voice coil of the moving-coil loudspeaker is transferred to the thermally conductive pad via a magnetic fluid, the thermally conductive bar, and the heat sink sequentially, to a basin frame of the moving-coil loudspeaker, for dissipation outside a speaker.

15. The heat dissipation device for a moving-coil loudspeaker according to claim 1, wherein heat generated by the electronic components is transferred to the thermally conductive pad via the circuit board, the thermally conductive bar, and the heat sink sequentially, to a basin frame of the moving-coil loudspeaker, for dissipation outside a speaker.

16. The heat dissipation device for a moving-coil loudspeaker according to claim 1, wherein the thermally conductive pad is a circular sheet-shaped thermally conductive pad.

17. The heat dissipation device for a moving-coil loudspeaker according to claim 1, wherein the thermally conductive bar is a bolt-shaped thermally conductive bar.

* * * * *